US006932085B2

(12) United States Patent
Krawczyk et al.

(10) Patent No.: US 6,932,085 B2
(45) Date of Patent: Aug. 23, 2005

(54) SECOND STAGE SWIVEL REGULATOR

(76) Inventors: Michael Thomas Krawczyk, 809 Kalpati Cir., #324, Carlsbad, CA (US) 92008; Edward Michael Szostak, 3428 Valemont St., San Diego, CA (US) 92106

( * ) Notice: Subject to any disclaimer, the term of this patent is extended or adjusted under 35 U.S.C. 154(b) by 0 days.

(21) Appl. No.: 10/628,968

(22) Filed: Jul. 28, 2003

(65) Prior Publication Data

US 2005/0022816 A1 Feb. 3, 2005

(51) Int. Cl.[7] ..... A61M 16/00; A62B 18/08; B63C 11/02

(52) U.S. Cl. ..... 128/204.26; 128/201.26; 128/201.27; 128/201.28; 405/186

(58) Field of Search ..... 128/201.11, 200.29, 128/201.26, 201.27, 201.28, 205.12, 205.24, 206.29, 204.26, 204.18, 207.16; 405/186, 187

(56) References Cited

U.S. PATENT DOCUMENTS

| | | | | |
|---|---|---|---|---|
| 4,336,537 A | | 6/1982 | Strickland | |
| 4,467,797 A | | 8/1984 | Franke | |
| 4,529,333 A | | 7/1985 | Robinette | |
| 5,127,398 A | * | 7/1992 | Stone | 128/204.18 |
| 5,213,095 A | | 5/1993 | Dague | |
| 5,265,591 A | | 11/1993 | Ferguson | |
| 5,351,681 A | | 10/1994 | Hudson | |
| 5,503,140 A | | 4/1996 | Winefordner et al. | |
| 5,724,961 A | * | 3/1998 | Tistrand | 128/205.24 |
| 6,039,043 A | | 3/2000 | Graber et al. | |
| 6,089,225 A | | 7/2000 | Brown et al. | |
| 6,263,871 B1 | | 7/2001 | Brown et al. | |
| 6,332,464 B1 | * | 12/2001 | Chen | 128/204.26 |
| 6,513,525 B2 | | 2/2003 | Chen | |
| 2002/0134385 A1 | * | 9/2002 | Pietrelli | 128/204.26 |

* cited by examiner

*Primary Examiner*—Teena Mitchell
(74) *Attorney, Agent, or Firm*—Gordon & Rees LLP

(57) ABSTRACT

A second stage regulator and a method for using the regulator is provided. The second stage regulator has a unique design to facilitate rotation of the mouthpiece about the regulator. The mouthpiece is able to be configured and reconfigured to adapt to a plurality of uses, including commercial, emergency, military and individual use. The second stage regulator also has a plurality of openings allowing for interchangability of parts. The second stage regulator has a unique ergonomic design for optimum user configuration control. The mouthpiece may be interchanged with the exhaust opening and/or blank opening, and the exhaust may be interchanged with the mouthpiece opening and/or blank opening.

23 Claims, 4 Drawing Sheets

SECOND STAGE SWIVEL REGULATOR

FIELD OF THE INVENTION

This invention relates to the field of a breathing apparatus. More specifically, this invention relates to a second stage or demand regulator that allows for multiple configurations by a user. Further, this invention relates to a second stage regulator that allows for interchangeability of parts.

BACKGROUND OF THE INVENTION

The sport of scuba diving, is the result of developments and innovations that began hundreds of years ago. Scuba diving is the most extensively used system for breathing underwater by recreational, scientific, commercial and military divers throughout the world.

Scuba diving equipment typically consists of masks, fins and a compressed air cylinder. Another essential piece of diving equipment is a regulator. The regulator is a device that allows a scuba diver to breathe air while under water. The regulator uses valves to release air from high pressure air cylinder that are usually attached to the diver. The regulator reduces the high pressure gas supplied by the air cylinder to an ambient pressure surrounding the diver at depth. Most often, the regulator uses a inhalation responsive diaphragm. Typically, regulators have two stages. The first stage regulator is attached to or near the air supply cylinder. The first stage regulator reduces the pressure to an intermediate pressure. The intermediate pressure fills a low pressure hose that connects the first stage of the regulator to the second stage. The second stage of the regulator further reduces the pressure to the diver in the mouth piece. The mouth piece is connected to the regulator to allow the diver to have air delivered to the diver upon demand. Further, an exhaust outlet is provided on the regulator to allow the discharge of expelled air from the diver.

However, the typical mouth piece on the market today is fixedly connected, secured and/or fastened to the regulator. The fixed position of the mouth piece about the regulator is determined based on the design and use of the breathing apparatus. Therefore, for each different desired use of a breathing apparatus, a different regulator and/or mouth piece must be used. The mouth piece must be situated in a position that is convenient for a particular use.

A further problem exists because no mouthpiece and/or regulator combination exists that may be used for a variety of breathing apparatus that may be adjusted to comfortably allow for easy connection to the air cylinder. Further, no mouthpiece and/or regulator combination exists that may be adjusted by a user for a variety of different uses in connection with a breathing apparatus.

Another problem exists wherein the regulator may not be reconfigured to allow for interchangeability of the mouthpiece and the exhaust cover.

What is needed is a mouthpiece that may be removably attached to a regulator in a manner that allows the mouthpiece to be rotated about the regulator for use with a variety of different breathing apparatus. Further, a need therefore exists for a regulator that provides ergonomic options to a user of a second stage regulator with mouthpiece placement at various positions. Further, a regulator is needed that allows for easy reconfiguration such that the exhaust and the mouthpiece placement may be interchangeable.

SUMMARY OF THE INVENTION

The present invention provides a second stage regulator with a unique three hundred and sixty degree swivel capability. More specifically, the present invention provides a second stage regulator having a mouthpiece and/or regulator with a unique design allowing it to be rotatable with respect to each other. The present invention also provides a second stage regulator and a method for using the same. Further, the present invention provides a second stage regulator that may contain interchangeable parts.

To this end, in an embodiment of the present invention, a second stage regulator is provided. The regulator has a chamber having a cylindrical body. The regulator also has a first opening on the cylindrical body wherein an exhaust valve is removably attached to the first opening of the cylindrical body. The regulator also has a second opening on the cylindrical body wherein a mouthpiece is removably attached to the second opening of the cylindrical body. Further, the regulator has a hose connected to the chamber wherein the hose connects the cylindrical body to the air source.

In an embodiment, the second stage regulator has a third opening in the cylindrical body wherein the third opening in the cylindrical body has a blanking plug.

In an embodiment, the second stage regulator has an exhaust mount removably attached to the first opening wherein the exhaust valve attaches to the exhaust mount.

In an embodiment, the second stage regulator has a mouthpiece that is rotatable about the regulator to three hundred and sixty degrees.

In an embodiment, the second stage regulator has a mouthpiece having an attachment means with a plurality of sides for attachment to the regulator.

In an embodiment, the second stage regulator has an attachment means with a plurality of sides thereon for attachment to the mouthpiece.

In an embodiment, the second stage regulator has an attachment means wherein the attachment means of the regulator accommodates the attachment means of the mouthpiece for placement of the mouthpiece onto the regulator wherein the plurality of sides of the mouthpiece correspond to the plurality of sides positioned on the regulator.

In an embodiment, the second stage regulator has a mouthpiece that is secured to the regulator in a plurality of positions wherein the secured position is defined by the plurality of sides on the mouthpiece fitting about a pattern on the regulator.

In an embodiment, the second stage regulator has a mouthpiece that may be attached to any of the first opening, the second opening and the third opening.

In an embodiment, the second stage regulator has an exhaust valve attached to any of the first opening, the second opening and the third opening.

In an embodiment of the present invention, a second stage regulator is provided. The second stage regulator has a chamber having a cylindrical body. The regulator has a first opening on the cylindrical body. Further, the regulator has an exhaust valve removably attached to the first opening of the cylindrical body. The regulator also has a second opening on the cylindrical body, and a mouthpiece removably attached to the second opening of the cylindrical body wherein the mouthpiece has a first side adapted for insertion into a mouth and a second side having a plurality of sides contained thereon. The regulator further, has a third opening on the cylindrical body wherein the third opening has a blanking plug contain thereon, and a hose connected to the chamber wherein the hose connects the cylindrical body to the air source.

In an embodiment, the second stage regulator has a cylindrical body having a configuration of sides on any of the first side, second side and third side adapted for reception of the plurality of sides contained on the mouthpiece.

In an embodiment, the second stage regulator has a mouthpiece that is removably attached to any of the first opening, second opening and third opening.

In an embodiment, the second stage regulator has a mouthpiece that is rotatable about the regulator.

In an embodiment of the present invention, a method for using a second stage regulator is provided. The method has the steps of:

providing a regulator having a first opening, a second opening, and a third opening;

providing a mouthpiece that is removably attached to the regulator; providing an exhaust means for discharging used air supply; connecting a hose from the regulator to the air source;

connecting the mouthpiece to the regulator wherein the mouthpiece may be connected to the regulator in a plurality of positions; and connecting the regulator via the hose to the air source.

In an embodiment, the method comprises the step of allowing mounting of the regulator in connection with a plurality of configurations.

In an embodiment, the method comprises the step of reconfiguring the mouthpiece attachment position in relation to the regulator prior to use.

In an embodiment, the method comprises the step of reconfiguring the mouthpiece attachment position in relation regulator during use.

In an embodiment, the method comprising the step of allowing the interchange of the mouthpiece between the first opening, the second opening and the third opening.

In an embodiment, the method comprises the step of allowing the mouthpiece to swivel to three hundred and sixty degrees about the regulator.

It is, therefore, an advantage of the present invention to provide a second stage regulator and a method for using the same.

Another advantage of the present invention is to provide a second stage regulator and a method for using the same wherein the mouthpiece may swivel and or rotate 360 degrees about the regulator.

Yet another advantage of the present invention is to provide a second stage regulator and a method for using the same wherein the regulator may be configured to allow for multiple configurations of the second stage for emergency use.

Still another advantage of the present invention is to provide a second stage regulator and a method for using the same wherein the regulator may be mounted on a flight jacket.

Another advantage of the present invention is to provide a second stage regulator and a method for using the same wherein the regulator may be mounted to a harness.

Yet another advantage of the present invention is to provide a second stage regulator and a method for using the same wherein a mouthpiece may be provided.

Still another advantage of the present invention is to provide a second stage regulator and a method for using the same wherein a uniquely designed mouthpiece may be provided.

Another advantage of the present invention is to provide a second stage regulator and a method for using the same wherein a mouthpiece may be uniquely configured to a regulator prior to use.

Yet another advantage of the present invention is to provide a second stage regulator and a method for using the same wherein a mouthpiece may be uniquely configured to a regulator during use of the regulator.

Still another advantage of the present invention is to provide a second stage regulator and a method for using the same wherein a mouthpiece may be adjusted during use of the regulator.

Another advantage of the present invention is to provide a second stage regulator and a method for using the same wherein a mouthpiece may be uniquely designed integral to the regulator such that the mouthpiece may be rotated on the regulator to pre-determined positions.

Yet another advantage of the present invention is to provide a second stage regulator and a method for using the same wherein a regulator may have interchangeable parts.

Still another advantage of the present invention is to provide a second stage regulator and a method for using the same wherein a plurality of openings are provided for a mouthpiece and exhaust.

Another advantage of the present invention is to provide a second stage regulator and a method for using the same wherein a mouthpiece positioning may be interchangeable with the exhaust cover positioning.

Yet another advantage of the present invention is to provide a second stage regulator and a method for using the same wherein mouthpiece may have a hexagonal pattern and/or any other symmetric polygonal pattern.

Still another advantage of the present invention is to provide a second stage regulator and a method for using the same wherein the regulator may have a hexagonal pattern embodied thereon.

An advantage of the present invention is to provide a second stage regulator and a method for using the same wherein the mouthpiece is slidably connected to the regulator.

Yet another advantage of the present invention is to provide a second stage regulator and a method for using the same wherein the mouthpiece may swivel with the assistance of a clamping nut.

Still another advantage of the present invention is to provide a second stage regulator and a method for using the same wherein the mouthpiece may be removed and/or attached with fasteners.

Another advantage of the present invention is to provide a second stage regulator and a method for using the same wherein the mouthpiece may be ratcheted to the regulator.

Another advantage of the present invention is to provide a second stage regulator and a method for using the same wherein a unique pattern on the mouthpiece may directly correspond to a unique pattern contained on the regulator to lock the mouthpiece into the regulator.

These and other objects of the invention will become more clear when one reads the following specification, taken together with the drawings that are attached hereto. The scope of protection sought by the inventors may be gleaned from a fair reading of the claims that conclude this specification.

Additional features and advantages of the present invention are described in, and will be apparent from, the detailed description of the presently preferred embodiments and from the drawings.

DESCRIPTION OF THE PREFERRED EMBODIMENT

Figure 1:
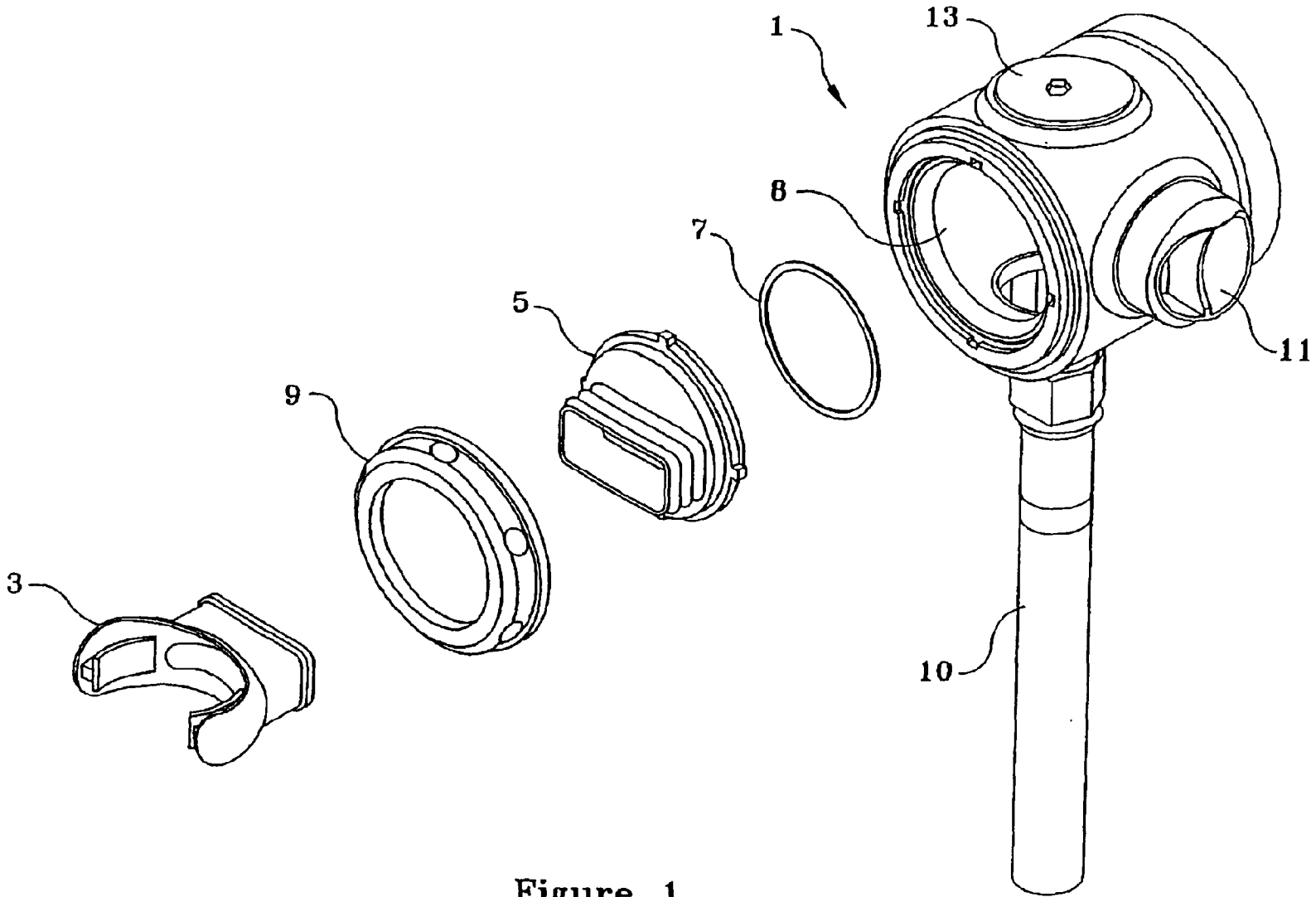
FIG. 1 is a perspective view of the second stage regulator in an embodiment of the present invention.
Figure 2:
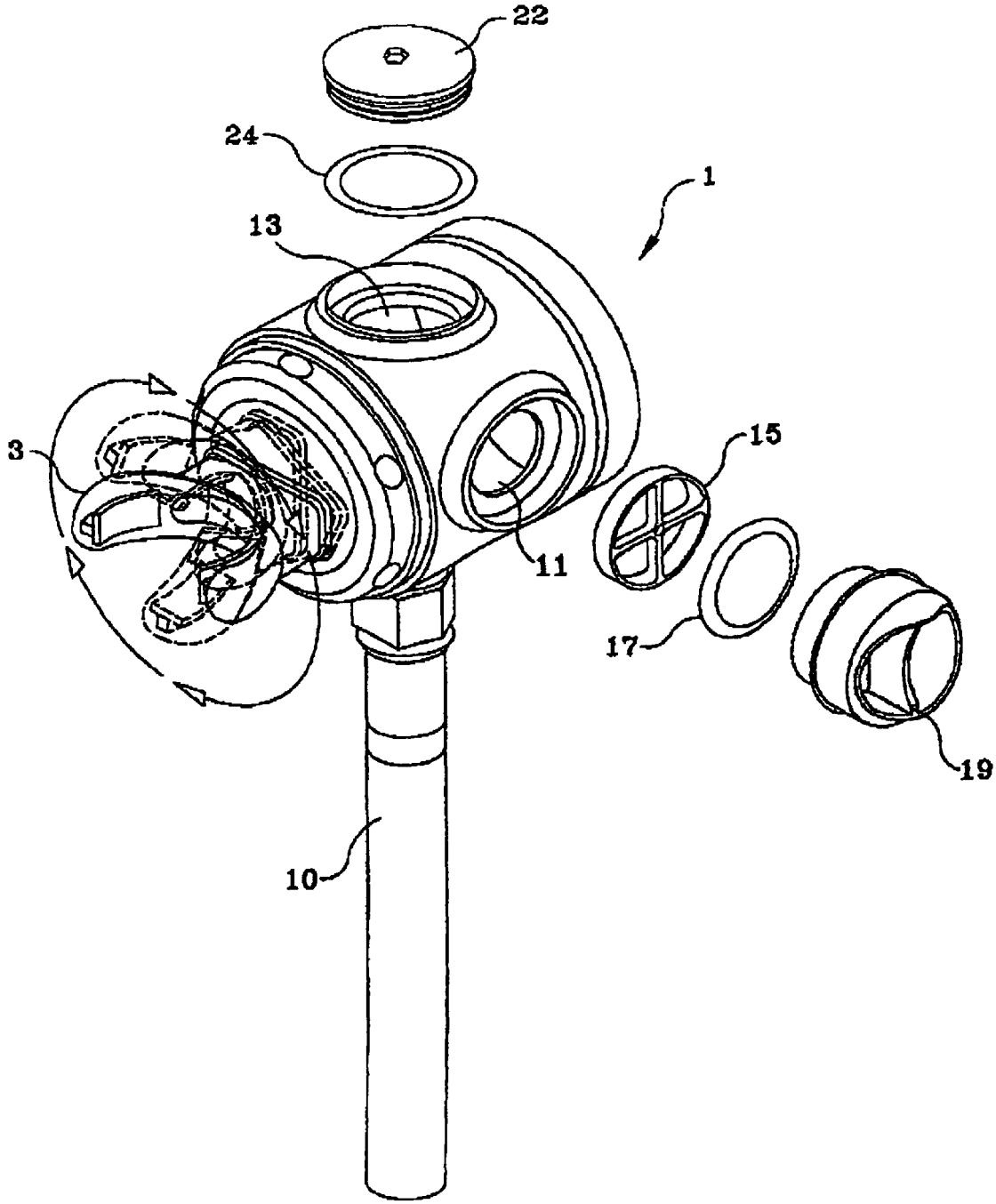
FIG. 2 is a perspective view of the second stage regulator in an embodiment of the present invention.

Turning now to the drawings wherein elements are identified by numbers and like elements are identified by like numbers throughout the 5 figures, the invention is depicted in FIG. 1 that shows a second stage regulator. As shown in FIGS. 1 and 2, the second stage regulator 1 may include a mouthpiece 3 which may attach to the regulator 1. The mouthpiece 1 may be attached to the regulator 1 by a mouthpiece orifice 5. The mouthpiece orifice 5 may be secured to the regulator 1 by an O ring 7. The orifice 5 and the O ring 7 may provide a tight fit to the regulator 1 such that when a user is employing the regulator, air does not escape from the regulator 1 because of an improper mouthpiece fit. The mouthpiece 3 may be inserted into the mouthpiece orifice 5 using a mouthpiece bezel 9. The mouthpiece bezel 9 may fit onto the mouthpiece orifice 5 and secures the mouthpiece 3 to the regulator 1. The mouthpiece 3 may be preferably made of strong plastic such that the mouthpiece 3 may bend to accommodate the mouth of a user (not shown). The regulator 1 may have a plurality of openings additional to the mouthpiece opening 8 including an exhaust opening 11 and a blank opening 13. When the regulator 1 is being used, a hose 10 connects the regulator 1 to an air supply (not shown).

FIG. 2 illustrates the exhaust opening 11 showing a screw-in exhaust valve mount 15 which may be secured to the exhaust opening 11. The screw in exhaust valve mount 15 may be supported by an exhaust valve 17. The exhaust valve may secure the exhaust valve mount 15 to the regulator 1. An exhaust deflector 19 may be connected to the regulator 1. The exhaust deflector 19 may connect to the exhaust valve 17 and be secured to the regulator 1. The exhaust opening 11 may allow for expulsion of used air. FIG. 2 also illustrates a mouthpiece 3 connected to the regulator 1. In the present embodiment, the mouthpiece 3 is secured to the regulator 1. FIG. 2 further illustrates a blank opening 13. The blank opening 13 may be close using a blanking plug 22. The blanking plug 22 may be secured to the blank opening 13 by a O ring 24. In an embodiment of the present invention, regulator 1 may be reconfigured by interchanging the mouthpiece 3, exhaust valve 17 and the blanking plug 22. The mouthpiece may, for example, be interchanged with the exhaust valve 17, by removing the mouthpiece orifice 5 from the mouthpiece opening 8 and removing the exhaust mount 15, exhaust valve 17 and exhaust deflector 19. When removed, the mouthpiece orifice 5 and mouthpiece 3 may be secured to the exhaust opening 11 and the exhaust valve 17 and deflector 19 may be secured to the mouthpiece opening 8. Further, the blank opening 13 may also be used by either the exhaust valve 17 or the mouthpiece 3.

Figure 3:
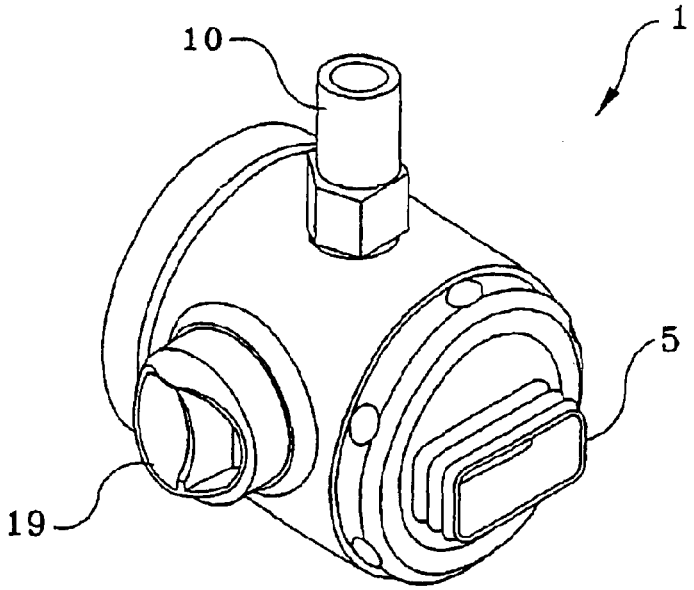
FIG. 3 is a three dimensional view of a regulator including a mouthpiece orifice, a hose and an exhaust vent in an embodiment of the present invention.

FIG. 3 illustrates an embodiment of the regulator 1 wherein the mouthpiece orifice is secured to the regulator 1. FIG. 3 further illustrates an embodiment wherein the exhaust deflector 19 is also secured to the regulator 1. A hose 10 extends away from the regulator 1 to the air supply (not shown).

Figure 4:
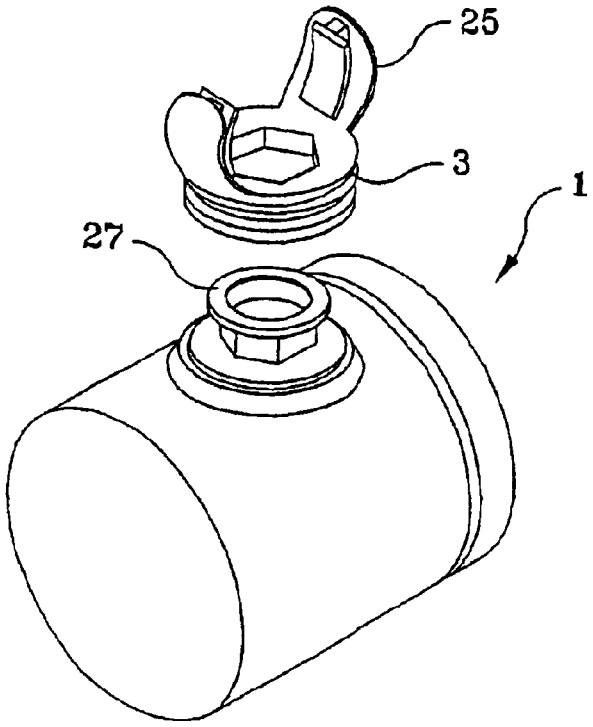
FIG. 4 is a three dimensional view of a mouthpiece and a regulator in an embodiment of the present invention.

FIG. 4 illustrates an embodiment of the connection between the mouthpiece 3 and the regulator 1. The mouthpiece 3 preferably has a pattern contained thereon that may be secure to the regulator 1. In a preferred embodiment, the mouthpiece 3 may have, for example, a hexagonal pattern 25 at its attachment point with the regulator 1. The hexagonal pattern 25 on the mouthpiece 3 may fit securely into a hexagonal pattern 27 on the regulator 1. The mouthpiece 3 may be secured to the regulator 1 such that the mouthpiece 3, when attached, does not rotate about the regulator 1. In a preferred embodiment, the mouthpiece 3 may be reconfigured into a plurality of positions on the regulator 1 during use. The hexagonal pattern 25,27 of the mouthpiece 3 and the regulator 1 may allow for rotation of the mouthpiece 3 about the regulator 1 yet still ensure a secure fit between the mouthpiece 3 and the regulator 1. The ability to reconfigure the placement of the mouthpiece 3 to the regulator 1, may, for example, allow for multiple uses for the breathing apparatus. A user may, for example, be able to use the regulator 1 in conjunction with a air supply that is mounted to a flight jacket. Alternatively, a user may, for example, be able to use the regulator 1 when mounted to a harness, buoyancy compensator device or the like. The mouthpiece 3 may also be reconfigured into a plurality of positions on the regulator 1 prior to use. The mouthpiece 3 may be rotatable about the regulator 1 to three hundred and sixty degrees, thus making the regulator easy to use for a plurality of different functions.

Figure 5:
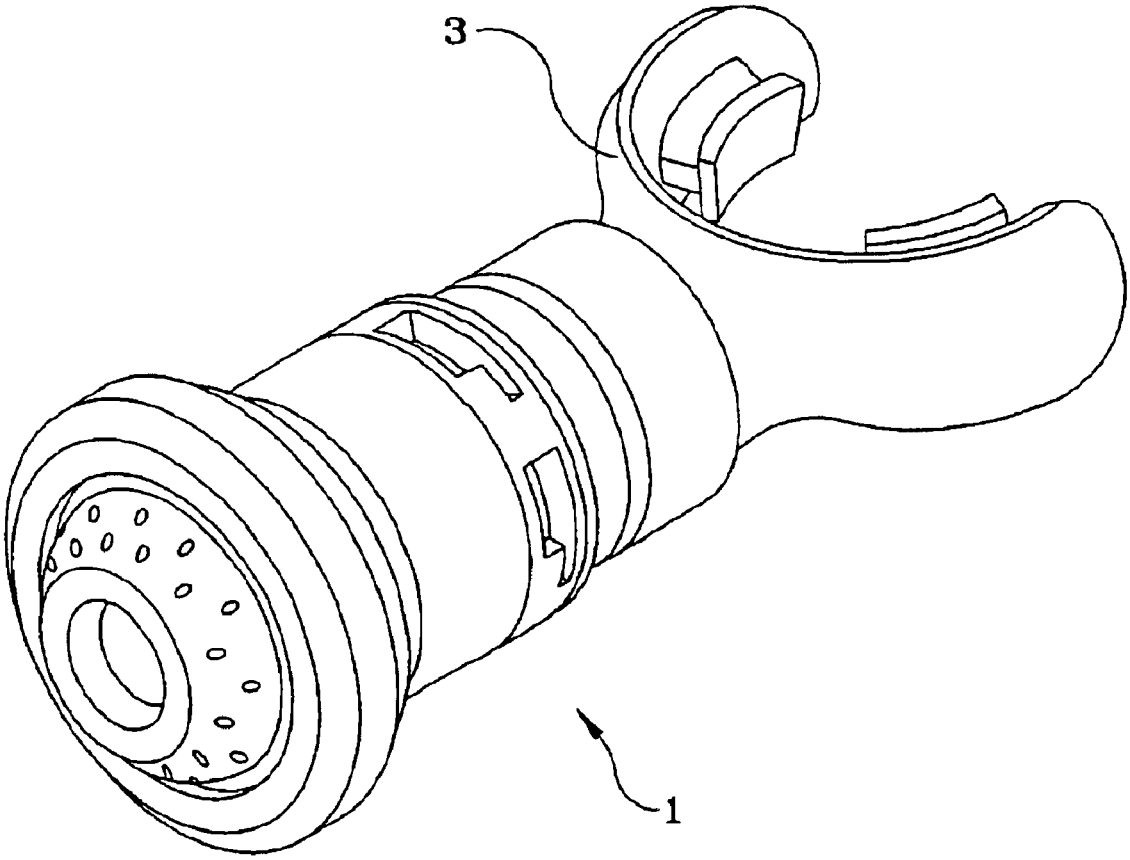
FIG. 5 is a three dimensional view of a mouthpiece attached to a regulator in an embodiment of the present invention.

Referring now to FIG. 5, an assembled regulator 1 is illustrated. The mouthpiece 3 may be secured to the regulator 1 and locked into place for use.

It should be understood that various changes and modifications to the presently preferred embodiments described herein will be apparent to those skilled in the art. Such changes and modifications may be made without departing from the spirit and scope of the present invention and without diminishing its attendant advantages.

What is claimed is:

1. A second stage regulator comprising:

a chamber having a cylindrical body;

a first opening on the cylindrical body wherein an exhaust valve is removably attached to the first opening of the cylindrical body;

a second opening on the cylindrical body wherein a mouthpiece is removably attached to the second opening of the cylindrical body and further wherein said mouthpiece is rotatable about the regulator;

a hose connected to the chamber wherein the hose connects the cylindrical body to an air source.

2. The second stage regulator of claim 1, further comprising:

a third opening in the cylindrical body wherein the third opening in the cylindrical body has a blanking plug.

3. The second stage regulator of claim 1, further comprising:

an exhaust mount removably attached to the first opening wherein the exhaust valve attaches to the exhaust mount.

4. The second stage regulator of claim 1 wherein the mouthpiece is rotatable about the regulator three hundred and sixty degrees.

5. The second stage regulator of claim 1 wherein the mouthpiece has an attachment means with a plurality of sides for attachment to the regulator.

6. The second stage regulator of claim 1 wherein the regulator has an attachment means with a plurality of sides thereon for attachment to the mouthpiece.

7. The second stage regulator of claim 1 wherein the attachment means of the regulator accommodates the attachment means of the mouthpiece for attachment of the mouthpiece to the regulator wherein the plurality of sides of the mouthpiece correspond to the plurality of sides on the regulator.

8. The second stage regulator of claim 1 wherein the mouthpiece may be secured to the regulator in a plurality of positions wherein a secured position is defined by the plurality of sides on the mouthpiece fitting about a pattern on the regulator.

9. The second stage regulator of claim 1 wherein the mouthpiece may be attached to any of the first opening, the second opening and the third opening.

10. The second stage regulator of claim 1 wherein the exhaust valve may be attached to any of the first opening, the second opening and the third opening.

11. A second stage regulator comprising:

a chamber having a cylindrical body;

a first opening on the cylindrical body;

an exhaust valve removably attached to the first opening of the cylindrical body;

a second opening on the cylindrical body wherein said second opening has plurality of sides thereon for attachment to a mouthpiece;

the mouthpiece is removably attached to the second opening of the cylindrical body wherein the mouthpiece has a first side adapted for insertion into a mouth and a second side having a plurality of sides contained thereon;

a third opening on the cylindrical body wherein the third opening has a blanking plug contain thereon; and a hose connected to the chamber wherein the hose connects the cylindrical body to the air source.

12. The second stage regulator of claim 11 wherein the cylindrical body has a configuration of sides on any of the first side, second side and third side adapted for reception of the plurality of sides contained on the mouthpiece.

13. The second stage regulator of claim 11 wherein the mouthpiece may be removably attached to any of the first opening, second opening and third opening.

14. The second stage regulator of claim 11 wherein the mouthpiece is rotatable about the regulator.

15. A method for using a second stage regulator, the method comprising the steps of:

providing a regulator having a first opening, a second opening, and a third opening;

providing a mouthpiece that is removably attached to the regulator wherein said mouthpiece is rotatable about the regulator at different angles;

providing an exhaust means for discharging used air supply;

connecting a hose from the regulator to the air source;

connecting the mouthpiece to the regulator wherein the mouthpiece may be connected to the regulator in a plurality of positions; and connecting the regulator via the hose to the air source.

16. The method of claim 15 further comprising the step of:

allowing mounting of the regulator in connection with a plurality of configurations.

17. The method of claim 15 further comprising the step of:

reconfiguring a mouthpiece attachment position in relation to the regulator prior to use.

18. The method of claim 15 further comprising the step of:

reconfiguring a mouthpiece attachment position in relation to the regulator during use.

19. The method of claim 15 further comprising the step of:

allowing the interchange of the mouthpiece between the first opening, the second opening and the third opening.

20. The method of claim 15 further comprising the step of:

allowing the mouthpiece to swivel to three hundred and sixty degrees about the regulator.

21. The method of claim 15 further comprising the step of:

attaching the mouthpiece to the regulator with a threaded clamping ring.

22. The method of claim 15 further comprising the step of:

attaching the mouthpiece to the regulator such that the mouthpiece can change position by ratcheting about the regulator.

23. The method of claim 15 further comprising the step of:

attaching the mouthpiece to the regulator by establishing a hexagonal pattern onto the mouthpiece wherein the regulator has a similarly configured hexagonal pattern contained thereon to removably attach the mouthpiece to the regulator.

* * * * *